US007242358B2

(12) United States Patent
Noh

(10) Patent No.: US 7,242,358 B2
(45) Date of Patent: Jul. 10, 2007

(54) WIDEBAND GLASS ANTENNA FOR VEHICLE

(75) Inventor: Yong-Ho Noh, Hwaseong-si (KR)

(73) Assignee: Hyundai Motor Company, Yangjae-Dong, Seocho-Ku, Seoul (KR)

( * ) Notice: Subject to any disclaimer, the term of this patent is extended or adjusted under 35 U.S.C. 154(b) by 54 days.

(21) Appl. No.: 11/299,367

(22) Filed: Dec. 8, 2005

(65) Prior Publication Data

US 2007/0091002 A1 Apr. 26, 2007

(30) Foreign Application Priority Data

Oct. 26, 2005 (KR) ..... 10-2005-0101196

(51) Int. Cl.
*H01Q 1/32* (2006.01)

(52) U.S. Cl. ..... 343/713; 343/866; 343/741

(58) Field of Classification Search ..... 343/713, 343/711, 866, 741
See application file for complete search history.

(56) References Cited

U.S. PATENT DOCUMENTS 5,646,637 A * 7/1997 Miller ..... 343/713
5,675,347 A * 10/1997 Terashima et al. ..... 343/713
5,825,335 A * 10/1998 Arai et al. ..... 343/866

FOREIGN PATENT DOCUMENTS

JP 2001-119223 4/2001
JP 2005-012587 1/2005

* cited by examiner

*Primary Examiner*—Hoang V. Nguyen
(74) *Attorney, Agent, or Firm*—Morgan Lewis & Bockius LLP

(57) ABSTRACT

Disclosed herein is a wideband glass antenna for a vehicle. The wideband glass antenna includes a loop antenna and a pattern. The loop antenna has a loop antenna pattern, in which a first side is connected to a feeding point, a second side is connected to a ground, and the two sides are connected to each other. The loop antenna pattern forms a predetermined space in the loop antenna. The pattern is formed in the loop antenna and is connected by a plurality of tuning arms for expanding a frequency band of the antenna.

8 Claims, 2 Drawing Sheets

WIDEBAND GLASS ANTENNA FOR VEHICLE

CROSS-REFERENCE TO RELATED APPLICATIONS

The present application is based on, and claims priority from, Korean Application Serial Number 10-2005-0101196, filed on Oct. 26, 2005, the disclosure of which is hereby incorporated by reference herein in its entirety.

FIELD OF THE INVENTION

The present invention relates generally to a wideband glass antenna for a vehicle and, more particularly, to the pattern structure of a wideband glass antenna for a vehicle, which can operates over a wide frequency band using a single antenna pattern.

BACKGROUND OF THE INVENTION

The structure of a conventional glass antenna for a vehicle must be designed to have antenna patterns corresponding to respective frequency bands, that is, radio and TeleVision (TV) antenna patterns, in order to operate over a wide frequency band. Furthermore, the conventional glass antenna must have separate Radio Frequency (RF) signal amplifiers for respectively amplifying a radio signal and a TV signal.

That is, the conventional glass antenna requires radio and TV antenna patterns and, thus, must be provided with six antenna patterns (AM/FM1, FM2, TV1, TV2, TV3 and TV4), so that six feeding points are required, and separate RF signal amplifiers for respectively amplifying radio and TV reception signals are required. Therefore, there is a problem in that the manufacturing cost of the antenna increases.

SUMMARY OF THE INVENTION

Embodiments of the present invention provide the pattern structure of a wideband glass antenna for a vehicle, which operates over a wide frequency band of 65 MHz~2 GHz using a single antenna pattern.

The wideband glass antenna for a vehicle according to an embodiment of the present invention includes a loop antenna and a pattern. The loop antenna has a loop antenna pattern, in which a first side is connected to a feeding point, a second side is connected to a ground, and the two sides are connected to each other. The loop antenna pattern forms a predetermined space in the loop antenna. The pattern is formed in the loop antenna and is connected by a plurality of tuning arms for expanding a frequency band of the antenna.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

A preferred embodiment of the present invention is described with reference to the accompanying drawings.

The pattern structure of a wideband glass antenna for a vehicle according to an embodiment of the present invention is described with reference to FIG. 1.

Figure 1:
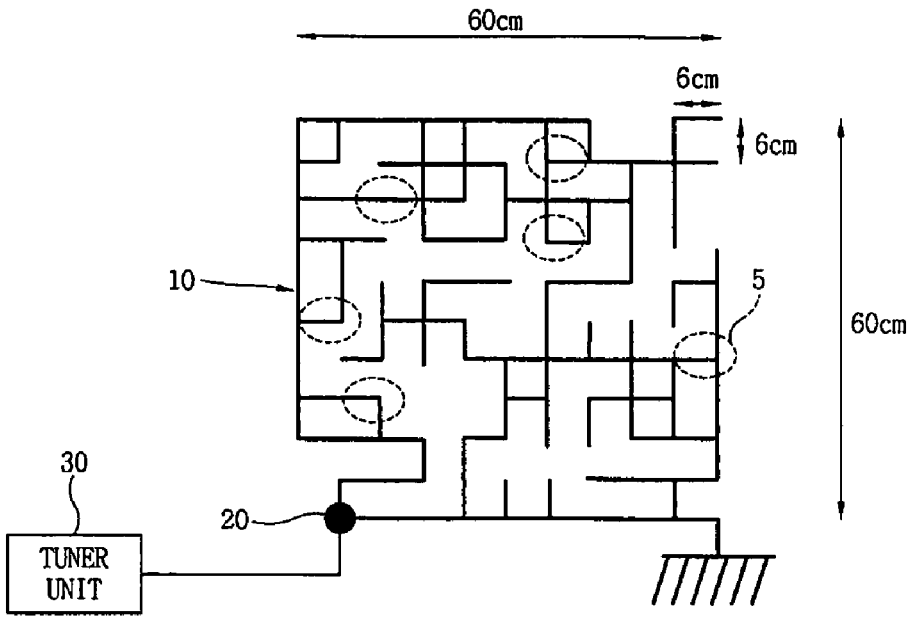
FIG. 1 is a diagram showing the pattern structure of a wideband glass antenna according to the present invention.

Referring to FIG. 1, the wideband glass antenna according to the embodiment includes a loop antenna 10 having a loop antenna pattern, in which one side is connected to a feeding point 20, the other side is connected to a ground GND, and the two sides are connected to each other, the loop antenna pattern forming a predetermined space in the loop antenna, and a pattern formed in the loop antenna 10 and connected by a plurality of tuning arms 5 for expanding the frequency band of the antenna.

Figure 2:
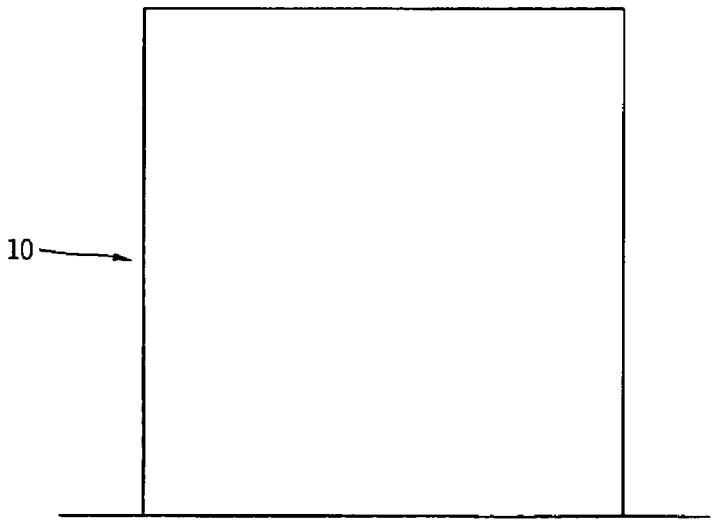
FIG. 2 is a diagram showing the loop antenna of the wideband glass antenna according to the present invention.

In this case, the loop antenna pattern according to the present embodiment has a square shape having a size of 60 m*60 cm (see FIG. 2), and the loop antenna has an impedance of 255 Ω. For reference, as known to those skilled in the art, the loop antenna is a directional antenna in which a wire is formed in the shape of a square, a rectangle, a triangle or a circle, and has characteristics in which, when the loop surface thereof is located in the propagation direction of an electric wave, an induced voltage is highest and has directionality, so that it is used chiefly for reception.

Figure 3:
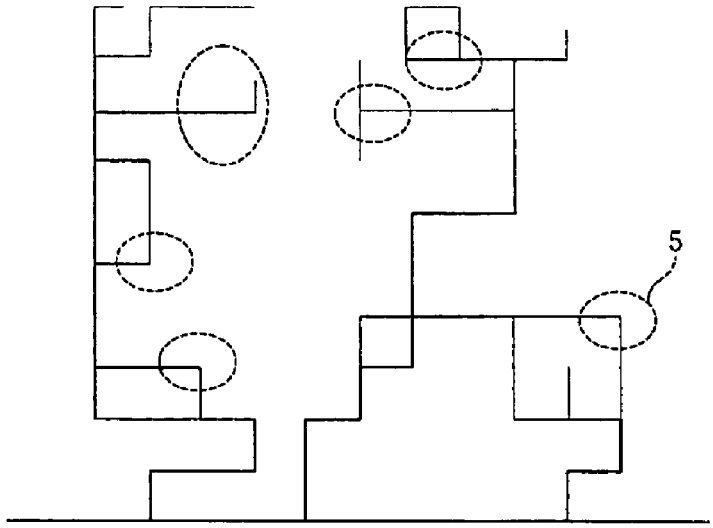
FIG. 3 is a diagram showing tuning arms formed within the loop antenna of the wideband glass antenna according to the present invention.

Furthermore, the number of tuning arms 5 within the loop antenna 10 is six, as shown in FIG. 3, and tuning arms 5 are connected by a pattern, that is, current paths, in order to maintain a certain impedance value. For reference, with respect to the antenna pattern shown in FIG. 3, thick portions indicate pattern portions where the extent of current distribution is high, and thin portions indicate pattern portions where the extent of current distribution is low.

The operating frequency band of the antenna pattern is 65 MHz~2 GHz, and such a frequency band supports radio, TV, GPS, PCS, GSM and satellite broadcasting service.

The number of feeding points 20 for feeding power to the antenna pattern is 1.

Furthermore, the wideband glass antenna further includes a tuner unit 30, which is connected to the feeding point of the antenna pattern and is configured to select a frequency radio signal.

The operation of the antenna having the above-described pattern according to the present embodiment is described with reference to FIG. 1.

As illustrated in FIG. 1, the antenna according to the present invention employs a single antenna pattern, which includes the tuning arms 5 forming current paths in the loop antenna 10 having an impedance of 255Ω, so that the antenna pattern has a frequency band of 65 MHz~2 GHz. Therefore, the single antenna pattern that operates over such a frequency band can support radio, TV, GPS, PCS, GSM or satellite broadcasting service.

Furthermore, as shown in FIG. 1, in the present embodiment, only one feeding point 20 is required, instead of 6 feeding points, in order to enable an antenna to operate over respective frequency bands, and a separate RF signal amplifier is not required because the intensity of the frequency signal is increased by the tuning arms formed in the antenna pattern.

Figure 4:
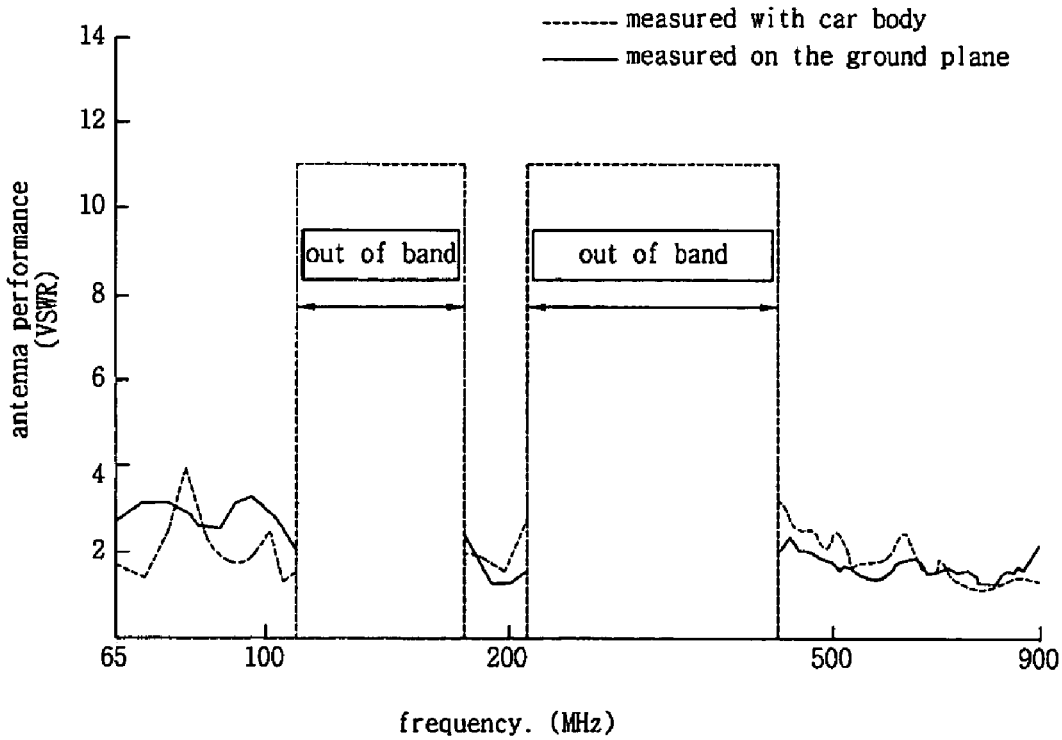
FIG. 4 is a diagram showing a performance measurement graph for the wideband glass antenna according to the present invention.

Meanwhile, the results of experiments for measuring the performance of the antenna pattern according to the present embodiment are plotted on the graph of FIG. 4.

As shown in FIG. 4, frequency signals are received throughout the frequency band between 65 MHz and 900 MHz, except for some frequency bands between 100~200 MHz and 200~500 MHz. For reference, 'an out-of-band range' does not exist in the frequency band of 900 MHz~2 GHz, and thus is not plotted on the graph of FIG. 4.

As above described, the present invention allows an antenna to operate in both radio and TV frequency bands using a single antenna pattern.

The wide band glass antenna of the present invention is advantageous in that radio and TV frequency signals can be received using a single glass antenna pattern, and it is possible to feed power to the antenna pattern using one feeding point without requiring a separate RF signal amplifier, thereby decreasing the manufacturing cost of the antenna.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wideband glass antenna for a vehicle, comprising:

a loop antenna having a loop antenna pattern, in which a first side is connected to a feeding point, a second side is connected to a ground, and the two sides are connected to each other, the loop antenna pattern forming a predetermined space in the loop antenna; and a pattern formed in the loop antenna and connected by a plurality of tuning arms for expanding a frequency band of the antenna.

2. The antenna as defined in claim 1, wherein the loop antenna pattern has a square shape having a size of 60 cm*60 cm.

3. The antenna as defined in claim 1, wherein the loop antenna has an impedance of 255Ω.

4. The antenna as defined in claim 1, wherein a number of tuning arms is six.

5. The antenna as defined in claim 1, wherein the antenna pattern has an operating frequency band of 65 MHz~2 GHz.

6. The antenna as defined in claim 5, wherein the frequency band supports radio, TV, GPS, PCS, GSM and satellite broadcasting service.

7. The antenna as defined in claim 1, wherein the antenna has a single feeding point for feeding power to the antenna pattern.

8. The antenna as defined in claim 1, further comprising a tuner unit connected to the feeding point of the antenna pattern and configured to select a frequency radio signal.

* * * * *